US007610706B2

(12) United States Patent
Pitcher et al.

(10) Patent No.: US 7,610,706 B2
(45) Date of Patent: Nov. 3, 2009

(54) ZIP LINE POD ARRANGEMENT

(75) Inventors: David E. Pitcher, Cambridge, MA (US); Thomas P. Burrous, Haverhill, MA (US); Rebecca C. Stover, Lynn, MA (US); Sidney Rose, Marblehead, MA (US); Alan L. Stenfors, Scituate, MA (US)

(73) Assignee: Rose Displays, Ltd., Salem, MA (US)

( * ) Notice: Subject to any disclaimer, the term of this patent is extended or adjusted under 35 U.S.C. 154(b) by 344 days.

(21) Appl. No.: 11/637,525

(22) Filed: Dec. 12, 2006

(65) Prior Publication Data

US 2008/0134554 A1 Jun. 12, 2008

(51) Int. Cl.
*G09F 7/00* (2006.01)

(52) U.S. Cl. ..... 40/617; 242/385; 248/329

(58) Field of Classification Search ..... 40/617; 248/227.4, 329, 330.1, 222.51; 242/385, 242/385.5, 385.4
See application file for complete search history.

(56) References Cited

U.S. PATENT DOCUMENTS

| | | | | |
|---|---|---|---|---|
| 685,856 | A * | 11/1901 | Menuez | 248/334.1 |
| 3,233,591 | A * | 2/1966 | Rogers et al. | 119/796 |
| 6,708,939 | B2 * | 3/2004 | Walker | 248/323 |
| 2004/0031898 | A1 * | 2/2004 | Mijatovic | 248/330.1 |

* cited by examiner

*Primary Examiner*—Cassandra Davis
(74) *Attorney, Agent, or Firm*—Don Halgren

(57) ABSTRACT

A stepwise-adjustable sign hanging device for supporting a sign from an overhead ceiling rail. The sign hanging device comprises a front housing and a rear housing enclosing a rotatably controllable spool arranged to stepwisedly dispense and retract a sign supporting line therefrom. A finger actuatable biased switch is arranged for release and locking of the spool with respect to the housing. A pair of ceiling rail engaging clips are arranged on an upper side of the housing to twistably engage an overhead ceiling rail.

9 Claims, 4 Drawing Sheets

ZIP LINE POD ARRANGEMENT

BACKGROUND OF THE INVENTION

1. Field of the Invention

This invention relates to sign holder arrangements which are suspended to a ceiling rail of a store, and more particularly to a rotatable spool which has a stop feature thereon for permitting adjustment and control of the height and the alignment of a sign suspended from a ceiling.

2. Prior Art

The use of signs in stores are more convenient when they are able to be supported from an overhead ceiling rail. Such signs permit shoppers to see advertisements about products which are easy to notice. To be able to do this well, a sign should be hung from the ceiling rail in an even manner. Since signs may come in various sizes, a support arrangement for those signs should be adjustable, so as to permit their level to be controlled and regulated, and their height as supported from ends of the sign, should be equivalent so as to not present an uneven or improperly supported sign.

It is an object of the present invention, to provide a sign holding mechanism which is an improvement over the prior art.

It is a further object of the present invention, to provide an attachable ceiling rail pod which permits accurate sign positioning when suspending a sign from such a ceiling rail.

It is a further object of the present invention, to provide a sign hanging system which is readily adjustable and accurately alignable with a second sign hanging arrangement.

It is a further object of the present invention, to provide a sign hanging system which may be easily attached to and removed from a ceiling rail.

It is also an object of the present invention, to provide such a sign supporting or suspending system which is economical to manufacture and very easy to use.

BRIEF SUMMARY OF THE INVENTION

The present invention comprises a height-wise adjustable line control member for attachment of a sign for support thereof, to a ceiling rail via a support pod attached thereto. The typical ceiling rail is an inverted T-shaped frame member which supports adjacent ceiling panels.

The support device in a first preferred embodiment thereof comprises a first or rear housing and a second mating housing. The first housing has a split axle extending centrally therefrom. A rotatable spool is rotatably supported on that split axle. The spool, mounted on the split axle, has a coil spring arranged within a central opening thereof. The coil spring has a first end lockably inserted between a diagonal cut in the split axle. The coil spring has a second end engaged in a slot within the opening of that spool. The spool is arranged to retract a sign support line which has been wrapped therearound. The support line extends through an opening in the first and the second housing portions.

A pivot axis extends from a corner portion of the rear first housing. An actuatable lever is pivotably disposed on that pivot axis extending from the corner of the rear first housing. The pivot axis includes a rigid first leg having a distal end with a release button thereon. The release button is exposed through an opening on the side portion on the first and second housing members. The actuatable lever has an arcuately shaped rigid second leg disposed in a spool engaging manner on the other side of the pivot axis. The second leg has a slot engagement foot thereon. The actuatable lever also has a bias finger extending unitarily from the hub of the lever. The bias finger provides resistance to the release button when the release button is pushed inwardly of the housing pair, towards the spool. The bias finger effects an upward resistance push onto the release button through the openings in the first and second housing and it effects a bias radially inwardly on the slot engagement foot on the distal end of the rigid second leg.

Preferably, only a single slot is arranged across the perimeter of the rotatable spool. The slot engagement foot of the actuatable lever is biased inwardly so as to mate with that slot in the perimeter of the spool.

The single slot in the perimeter of the rotatable spool minimizes any likelihood of miss-alignment between more than one of these suspension devices, although multiple slots in a further embodiment is also functional. Each first and second housing has an uppermost edge on which the rear edge engagement clip is disposed. The suspension device is twisted from an acute angle to linear alignment with the ceiling rail, so that the channels in each engagement clip engage the side edges of the lower portion of the ceiling rail.

It is intended that a typical sign being suspended from a ceiling rail would utilize at least two of these suspension devices. To minimize the complexity and time in making a proper horizontal alignment of a sign suspended from such a ceiling rail, the spool has only one slot extending across its lips. The line in any case wraps around the spool and is disposed underneath the slot engagement foot. Movement of that line relative to the support device is only permitted once the release button has been depressed inwardly, thus moving the slot engaging foot radially outwardly from its engagement with the slot on the perimeter of the spool. The line extending from the spool at that time may be retracted within the suspension device, by virtue of its re-wrapping because of the coil spring re-winding that spool within the housing. A second biasing arrangement is disposed within the housing to hold the line snugly against the spool as it winds and unwinds with respect thereof. The second biasing arrangement is comprised of a pair of fingers extending from a common pivot axis. A first finger of the biasing arrangement is pressed against a side wall of the rear housing and a second finger of the biasing arrangement is pressed radially inwardly against the line as it wraps or unwraps itself on/from the spool.

The invention thus comprises a stepwise-adjustable sign hanging device for supporting a sign from an overhead ceiling rail. The sign hanging device comprises a front housing and a rear housing enclosing a rotatably controllable spool arranged to stepwisedly dispense and retract a sign supporting line therefrom; a finger actuatable biased switch for any release and locking of the spool with respect to said housing; an arrangement of clips on the housing for twistably engaging the overhead ceiling rail. The biased switch may comprise a pivotable lever having a first depressible arm movable about a pivot axis arranged to release a locking foot from a notch in the spool. The switch may include a bias finger extending from the pivot axis arranged to first bias the locking foot in the notch until the first bias is overcome by a greater second bias applied to the first depressible arm. The switch may include an elongated finger movable in a depressed slot in a wall of the housing.

The invention also comprises a stepwise-adjustable sign hanging wherein the spool has a central opening for locking receipt of a coil spring to permit rewinding of a line thereon. The stepwise adjustable sign hanging device includes a second biasing arrangement comprising a first finger pressably disposed against a housing wall of device and a second finger pressably disposed against the line wrapped about the spool to insure the line is properly maintained on the spool.

The invention also comprises a method to stepwisedly lift and lower a sign suspended from an adjustable sign hanging device, comprising one or more of the steps of wrapping a sign supporting line around a spool within an housing enclosure; disengaging a first biasable finger arrangement from an engagement notch in a rim portion of the spool so as to permit the spool to rotate about an axis within the housing enclosure; biasing a second biased finger arrangement against the line wrapped around the spool to maintain the line from entanglement; and lowering the sign a controlled distance from the sign hanging device. The spool preferably has a single foot-engagement notch formed in said rim portion of the spool. The method may include the step of adjusting the line extending from the spool and re-winding the line about the spool by action of a tightened coil spring arranged between the spool and an axis mounted within the housing enclosure. The method may including the step of biasing the second biasable finger arrangement against the spool continuously, and biasing the first biasable finger arrangement intermittently to control the length and condition of the line extending from the device.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
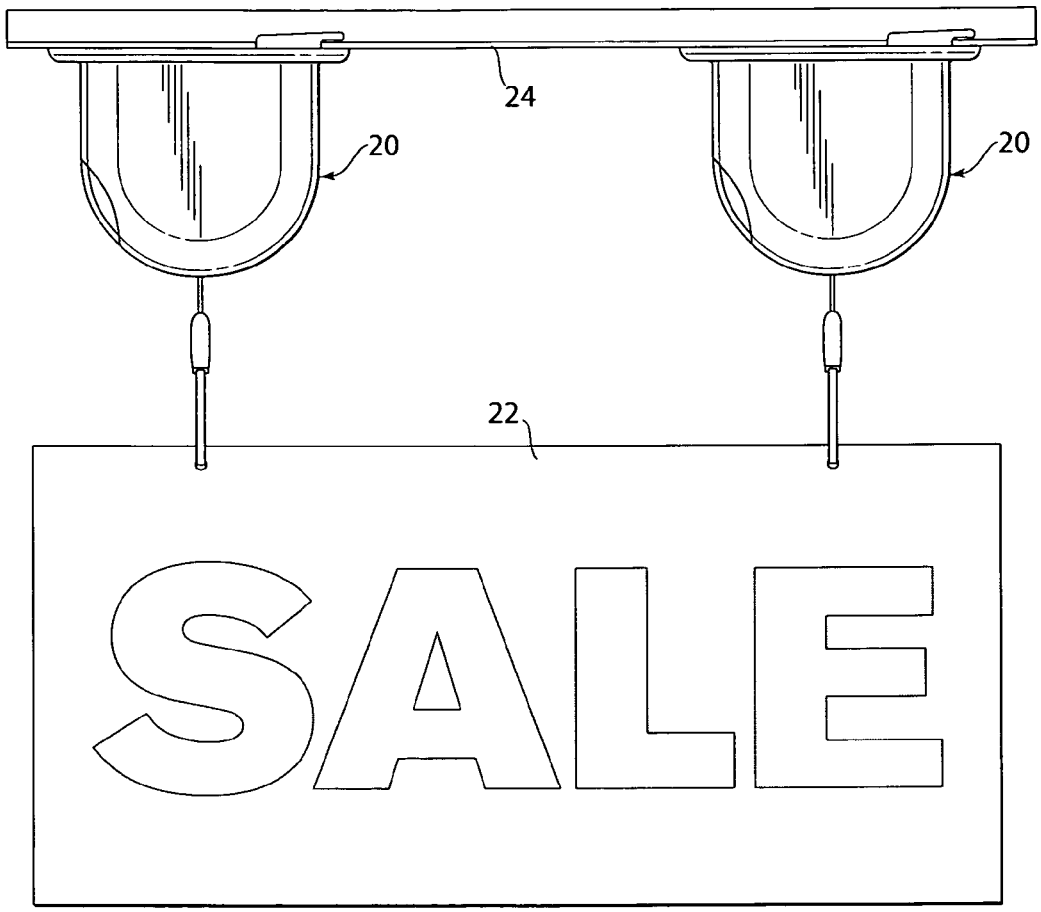
FIG. 1 is a side elevational view of a sign being supported by a pair of support devices of the present invention, the support devices being attached to a ceiling rail.

Referring now to the drawings in detail, and particularly to FIG. 1, there is shown the present invention which comprises a height-wise adjustable line control support device 20 for attachment of a sign 22 for support thereof, preferably to a ceiling rail 24. The typical ceiling rail 24 is an inverted T-shaped frame member which supports adjacent ceiling panels.

Figure 2:
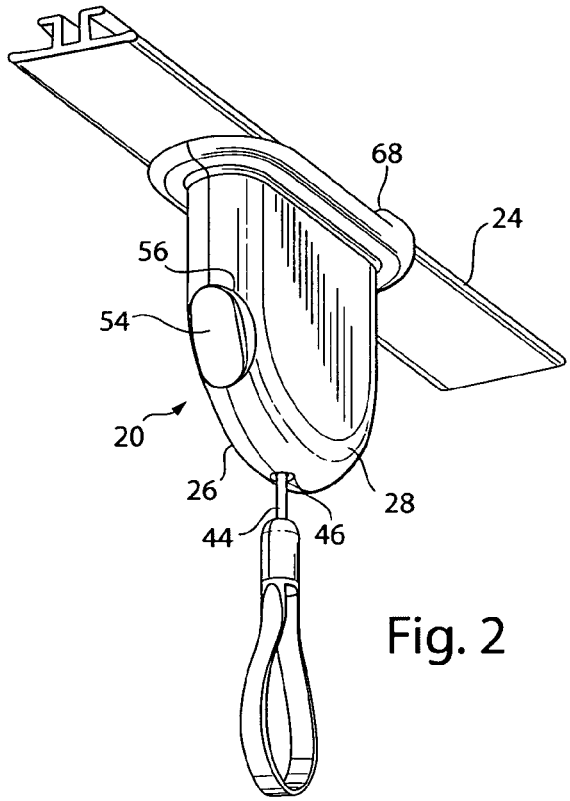
FIG. 2 is a perspective view of a support device of the present invention shown attached to a ceiling rail.
Figure 3:
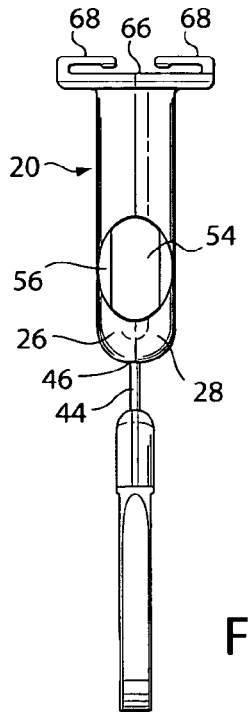
FIG. 3 is an edge view of the support device shown in FIG. 2.
Figure 4:
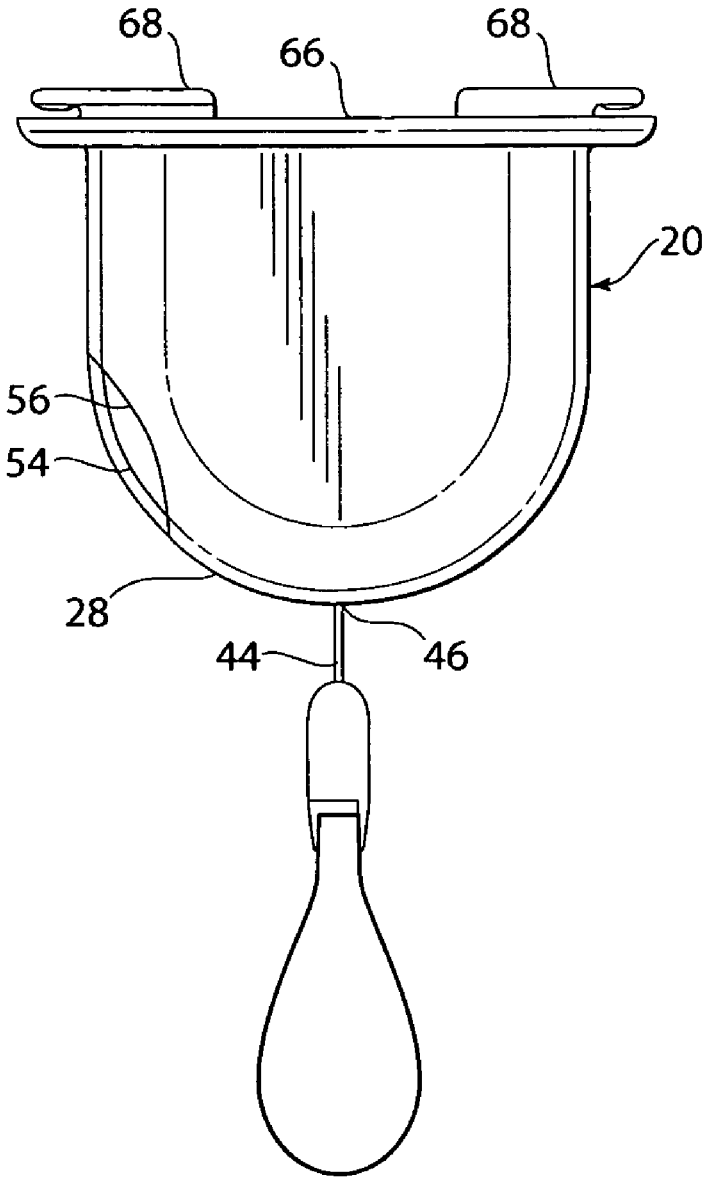
FIG. 4 is a side elevational view of the support device shown in FIG. 3.
Figure 6:
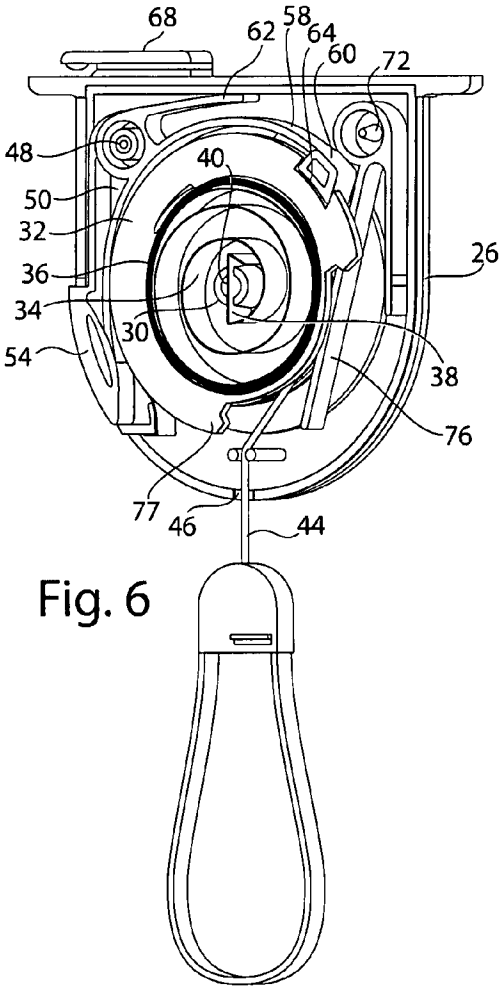
FIG. 6 is a perspective view of the support device shown in FIG. 5
Figure 5:
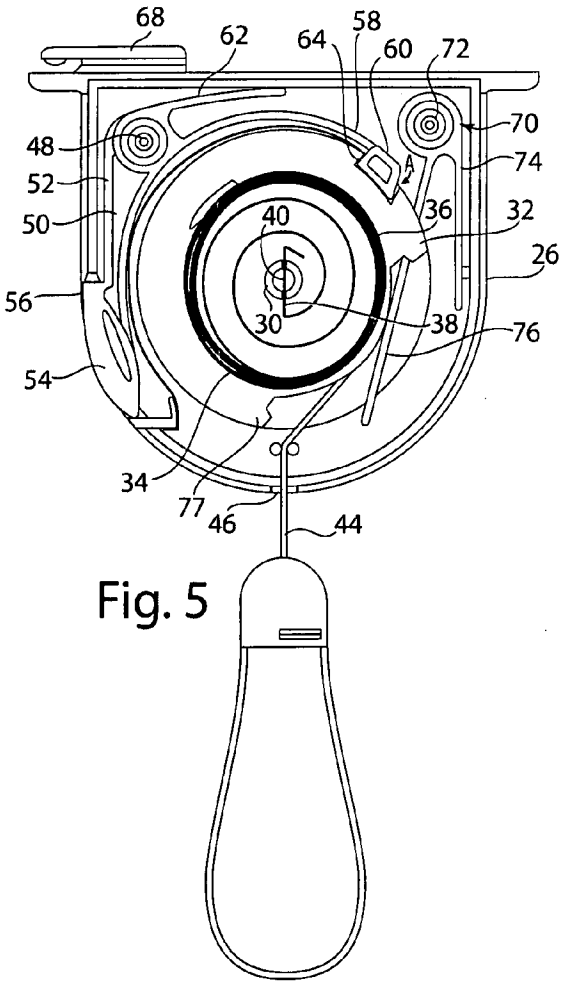
FIG. 5 is a side elevational view of the support device with its second housing member removed to show the internal mechanism thereof, and an annular portion of its rim removed to better show a line biasing arrangement therewith.

The support device 20 in a first preferred embodiment thereof comprises a first or rear housing 26 and a front or second mating housing 28, as shown in FIGS. 2, 3 and 4. The first housing 26 has a split axle 30 extending centrally from an inner wall thereof, as shown in FIGS. 5 and 6. A rotatable spool 32 is rotatably supported on that split axle 30. The spool 32, mounted on the split axle 30, has a coil spring 34 arranged within a central opening 36 thereof. The coil spring 34 has a first end 38 lockably inserted between a diagonal cut 40 in the split axle 30. The coil spring 34 has a second end engaged in a slot (not shown for clarity) within the opening 36 of that spool 32. The spool 32 is arranged to retract a sign support line 44 which has been wrapped around the hub of the spool 32. The support line 44 extends through an opening 46 between the first and the second housing portions 26 and 28, as shown in FIGS. 2-6.

A pivot axis 48 extends from a corner portion of the rear first housing 26. An actuatable lever 50 is pivotably disposed on that pivot axis 48 extending from the corner of the rear first housing 26, as represented in FIGS. 5 and 6. The lever 50 includes a rigid first leg 52 having a distal end with a release button 54 thereon. The release button 54 is exposed through an opening 56 on the side portion on the first and second housing members 26 and 28, as shown in FIGS. 2-5. The actuatable lever 50 has an arcuately shaped rigid second leg 58 disposed in a spool engaging manner on the other side of the pivot axis 48 as shown in FIGS. 5 and 6. The second leg 58 has a slot engagement foot 60 thereon. The actuatable lever 50 also has a bias finger 62 extending unitarily from the hub of the lever 50. The bias finger 62 provides resistance to the release button 54 when the release button 54 is pushed radially inwardly with respect to the pair of housing portions 26 and 28, towards the spool 32. The bias finger 62 effects an outward resistance push onto the release button 54 through the opening 56 between the first and second housings 26 and 28 and it effects a bias radially inwardly, (as shown by arrow "A" in FIG. 5), on the slot engagement foot 60 on the distal end of the rigid second leg 58.

A single slot 64 is arranged across a portion of the perimeter of the rim on the rotatable spool 32, as shown in FIG. 5. The slot engagement foot 60 of the actuatable lever 50 is biased inwardly so as to mate with that slot 64 the perimeter of the spool 32. FIGS. 5 and 6 show the spool 32 with an annular portion of its rim cut away for clarity of viewing. A second biasing arrangement 70 is disposed on a pivot axis 72, as represented in FIGS. 5 and 6. The second biasing arrangement 70 comprises a first finger 74 extending from a hub 73, and is arranged to press against the inside of the wall of the housings 26 and 28. A second finger 76 extends from the hub 73 and rides and biasedly pushes radially inwardly against the line 44 wrapped around the spool 32, as shown in FIGS. 5 and 6. The second finger 76 holds the line 44 snugly against the spool 32 as it winds therefrom.

The single slot 64 in the rim 77 of the rotatable spool 32 minimizes any likelihood of miss-alignment between more than one of these suspension devices 20. Each first and second housing 26 and 28 has an uppermost edge 66 on which the rail edge engagement clip 68 is disposed, as shown in FIGS. 3 and 4.

In the process of attaching the suspension device 20 to a ceiling rail 24, the device 20 is twisted from an acute angle to linear alignment with the ceiling rail 24, so that the channels in each engagement clip 68 engage the side edges of the lower portion of the ceiling rail 24.

It is intended that a typical sign being suspended from a ceiling rail would utilize at least two of these suspension devices 20 as shown in FIG. 1. To minimize the complexity and time in making a proper horizontal alignment of a sign 22 suspended from such a ceiling rail 24, as aforementioned, the spool 32 has only one slot 64 extending across its rim 77. The line 44 in any case wraps around the spool 32 and is pressably disposed underneath the slot engagement foot 60. Movement of that line 44 relative to the support device 20 is only permitted once the release button 54 has been depressed inwardly, thus moving the slot engaging foot 60 radially outwardly from its engagement with the slot 64 on the perimeter of the spool 32. The line 44 extending from the spool at that time may be retracted within the suspension device 20, by virtue of its re-wrapping because of the coil spring 34 re-winding that spool 32 within the housing 26 and 28.

We claim:

1. A stepwise-adjustable sign hanging device for supporting a sign from an overhead support, said sign hanging device comprising:

a front housing and a rear housing enclosing a rotatably controllable spool arranged to rotatably and stepwisedly dispense and retract a sign supporting line therefrom;

a first biasing arrangement comprising a finger actuatable biased switch for release and locking of said spool with respect to said housing, wherein said biased switch comprises a pivotable lever having a first depressable arm movable about a pivot axis arranged to release a locking foot from a notch in said spool, and wherein said switch includes bias finger extending from said pivot axis arranged to first bias said locking foot in said notch until said first bias is overcome by a greater second bias applied to said first depressible arm; and a clip arrangement on said housing for twistably engaging said overhead support.

2. The stepwise-adjustable sign hanging device as recited in claim 1, wherein said switch includes an elongated finger movable in a depressed slot in a wall of said housing.

3. The stepwise-adjustable sign hanging device as recited in claim 1, wherein said spool has a central opening for locking receipt of a coil spring to permit rewinding of a line thereon.

4. The stepwise adjustable sign hanging device as recited in claim 1, including a second biasing arrangement comprising a first finger pressably disposed against a housing wall of said device and a second finger pressably disposed against said line wrapped about said spool to insure said line is properly maintained on said spool.

5. The method as recited in claim 1, wherein said spool has a single foot-engagement notch formed in said rim portion of said spool.

6. The method as recited in claim 5, including:

adjusting said line extending from said spool by re-winding said line about said spool by action of a tightened coil spring arranged between said spool and an axis mounted within said housing enclosure.

7. The method as recited in claim 6, including:

biasing said second biasable finger arrangement against said spool continuously, and biasing said first biasable finger arrangement intermittently to control the length of said line extending from said device.

8. The stepwise adjustable sign hanging device as recited in claim 1, wherein said overhead support comprises an inverted T-shaped ceiling rail.

9. A method to stepwisedly lift and lower a sign suspended from an adjustable sign hanging device, comprising:

wrapping a sign supporting line around a spool within an housing enclosure;

dis-engaging a first biasable finger arrangement from an engagement notch in a rim portion of said spool so as to permit said spool to rotate about an axis within said housing enclosure;

biasing a second biased finger arrangement against said line wrapped around said spool to maintain said line from entanglement; and lowering said sign a controlled distance from said sign hanging device.

* * * * *